US007673367B2

(12) United States Patent
Kim et al.

(10) Patent No.: US 7,673,367 B2
(45) Date of Patent: Mar. 9, 2010

(54) CLEANING ROBOT

(75) Inventors: Jeong Hun Kim, Suwon-si (KR); Soo Sang Yang, Suwon-si (KR); Yeon Taek Oh, Yongin-si (KR); Youn Baek Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

(21) Appl. No.: 11/842,492

(22) Filed: Aug. 21, 2007

(65) Prior Publication Data

US 2008/0141485 A1 Jun. 19, 2008

(30) Foreign Application Priority Data

Dec. 18, 2006 (KR) ..... 10-2006-0129456

(51) Int. Cl.
*A47L 5/00* (2006.01)

(52) U.S. Cl. ..... 15/319; 15/339; 15/354

(58) Field of Classification Search ..... 15/340.1, 15/319, 339, 347, 354
See application file for complete search history.

(56) References Cited

U.S. PATENT DOCUMENTS

| | | | | |
|---|---|---|---|---|
| 5,815,880 | A | 10/1998 | Nakanishi | |
| 7,418,762 | B2 * | 9/2008 | Arai et al. | 15/319 |
| 2006/0010638 | A1 * | 1/2006 | Shimizu et al. | 15/319 |
| 2006/0021168 | A1 * | 2/2006 | Nishikawa | 15/49.1 |
| 2007/0113373 | A1 * | 5/2007 | Hato et al. | 15/354 |
| 2008/0066257 | A1 * | 3/2008 | Sun et al. | 15/319 |
| 2008/0282494 | A1 * | 11/2008 | Won et al. | 15/319 |

FOREIGN PATENT DOCUMENTS

| | | |
|---|---|---|
| DE | 4425924 | 1/1996 |
| JP | 04328607 | 11/1992 |
| JP | 08089455 | 4/1996 |
| JP | 2003038402 | 2/2003 |
| JP | 2004-337301 | 12/2004 |

OTHER PUBLICATIONS

European Search Report issued Sep. 25, 2009 in EP Application No. 07115023.9.

Ulrich I et al: "Autonomous vacuum cleaner" Robotics and Autonomous Systems, Elsevier Science Publishers, Amsterdam, NL, vol. 19, No. 3-4, Mar. 1, 1997, pp. 233-245, XP004075319 ISSN: 0921-8890 chapter 2.3.2* figures 3, 4 *.

* cited by examiner

*Primary Examiner*—Dung Van Nguyen
(74) *Attorney, Agent, or Firm*—Stanzione & Kim LLP

(57) ABSTRACT

A cleaning robot to prevent a suction member from moving upwards when the suction member is rotated during a collision with an obstacle, and which completely unfolds the suction member when a lower surface of the suction member travels on an uneven floor. The cleaning robot includes a main body to travel on a floor to be cleaned, a dust collecting unit, and a corner cleaning unit. The corner cleaning unit includes a suction member having a suction arm with a rotatable cylinder, a movable member rotatably coupled around the rotatable cylinder by a torsion spring such that the movable member can move upwards and downwards together with the suction member, a driving unit, supporting brackets, at least one elevation guide face to allow the movable member to move upwards and downwards along the elevation guide face as the movable member rotates, and at least one guide knob.

13 Claims, 8 Drawing Sheets

CLEANING ROBOT

CROSS-REFERENCE TO RELATED APPLICATIONS

This application claims priority under Korean Patent Application No. 2006-129456, filed on Dec. 18, 2006, respectively, in the Korean Intellectual Property Office, the disclosure of which is incorporated herein in its entirety by reference.

BACKGROUND OF THE INVENTION

1. Field of the Invention

The present general inventive concept relates to a cleaning robot, and more particularly to a cleaning robot having a corner cleaning unit to clean a corner adjacent to a wall, and a method thereof.

2. Description of the Related Art

A conventional cleaning robot is a cleaning apparatus that draws foreign materials such as dust from a floor while independently traveling in a cleaning area. The cleaning robot having a corner cleaning unit for cleaning a corner adjacent to a wall is disclosed in Japanese Patent Application Publication No. 2004-337301.

The corner cleaning unit disclosed in this document includes a suction member that is rotatably coupled to a main body to be unfolded outwards and is provided with a suction port at a lower portion thereof, and a rotational support that rotatably supports the suction member. The rotational support is provided with spiral guide slots on an inner surface thereof to allow the suction member to be raised and lowered by means of rotation, and the suction member is provided with protrusions inserted into the guide slots. Further, a torsion spring is interposed between the suction member and the rotational support.

With the above construction, the suction member can be unfolded by the elasticity of the torsion spring to maintain the unfolded state.

In the above corner cleaning unit, because the protrusions of the suction member are guided to be lowered by the guide slots of the rotational support when the suction member is unfolded outwards by means of rotation, the suction member is lowered. In contrast, because the suction member is rotated in an opposite direction when the suction member is folded toward the main body, and the protrusions of the suction member are guided to be raised by the guide slots of the rotational support, the suction member is raised.

However, the corner cleaning unit of the cleaning robot is adapted to allow the suction member to be rotated and folded when the suction member collides with an obstacle (e.g. the leg of a sofa, the leg of a chair, etc.) while the main body is traveling. In this case, the suction member is raised, and is greatly separated from the floor. As a result, a cleaning effect is degraded.

Further, when the cleaning robot travels on an uneven floor like a carpet, its wheels are buried under the surface of the carpet by means of the weight of the main body, the suction member is not sufficiently unfolded, and thus all the desired corner regions cannot be covered. Moreover, when the corner cleaning unit is not used, the suction member must be manually rotated and folded. Thus, the cleaning robot is inconvenient to use.

SUMMARY OF THE INVENTION

The present general inventive concept provides a cleaning robot to prevent a suction member from moving upwards when the suction member is rotated during a collision with an obstacle.

The present general inventive concept also provides a cleaning robot to completely unfold a suction member when a lower surface of the suction member travels along an uneven floor, such as a carpet.

The present general inventive concept also provides a cleaning robot to automatically fold and unfold the suction member.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may also be achieved by providing a cleaning robot, which includes a main body to travel on a floor to be cleaned, a dust collecting unit installed in the body, and a corner cleaning unit installed in the body. The corner cleaning unit may include a suction member having a suction arm unfolded from the main body by means of rotation and a rotatable cylinder connected to the suction arm, a movable member rotatably coupled around the rotatable cylinder of the suction member by means of a torsion spring such that the movable member is able to move upwards and downwards together with the suction member, a driving unit to rotate the movable member, supporting brackets provided in the body to support the driving unit, at least one elevation guide face formed at one of the supporting brackets to allow the movable member to move upwards and downwards along the elevation guide face as the movable member rotates, and at least one guide knob provided to the movable member in such a manner that the guide knob can move upwards and downwards along the elevation guide face.

The supporting brackets may be formed with rotation guide faces which extend from a lower end of each elevation guide face in the same direction as a rotating direction of the suction member to guide a rotational movement of the guide protrusion that has moved downwards along the elevation guide face.

A space may be formed above the elevation guide face and the rotation guide faces to allow the guide knob to move upwards.

The driving unit may include a cylindrical rotor installed on an outer surface of the movable member to rotate the movable member, and may be formed with long guide slots aligned in a longitudinal direction in order to guide upward and downward movement of the guide protrusion, and a driving motor coupled with the support bracket to rotate the cylindrical rotor in a forward or reverse direction.

The driving unit may also include a driving gear coupled to a shaft of the driving motor to transmit rotational force of the driving motor to the cylindrical rotor, and a driven gear provided at an outer surface of the cylindrical rotor to be engaged with the driving gear.

The cylindrical rotor may be rotatably supported on the support bracket in a state in which the upward and downward movement of the cylindrical rotor is restricted.

Also, the cylindrical rotor may be provided therein with a coil spring to bias the movable member in a downward direction.

The rotatable cylinder may be provided therein with a suction channel, and the suction channel may be connected to the dust collecting unit through a connecting pipe.

The guide knobs may be provided with rollers, respectively, in such a manner that the rollers are able to roll along the elevation guide faces and the rotation guide faces.

The foregoing and/or other aspects and utilities of the present general inventive concept may also be achieved by providing a cleaning robot, which includes a main body to travel on a floor to be cleaned, a dust collecting unit installed in the main body, and a corner cleaning unit installed in the main body. The corner cleaning unit may include a suction member having a suction arm unfolded from the main body by means of rotation and a rotatable cylinder connected to the suction arm, and a driving motor to rotate the rotatable cylinder in a forward or reverse direction to automatically fold or unfold the suction arm.

The foregoing and/or other aspects and utilities of the present general inventive concept may also be achieved by providing a cleaning robot, including a main body, and a corner cleaning unit having a suction member, and to move the suction member in a folding direction and an unfolding direction with respect to the main body, and to move the suction member in an upward direction and a downward direction with respect to the main body, when the suction member moves to the folding direction and the unfolding direction.

The corner cleaning unit may control the suction member to simultaneously move in the unfolding direction and the downward direction, and to simultaneously move in the folding direction and the upward direction.

The corner cleaning unit may include a driving unit mounted to the main body to control the suction member to move in one of the folding direction and the unfolding direction, and a bracket mounted to the main body to guide the suction member to move in one of the downward direction and the upward direction.

The cleaning robot may further include a movable member disposed between the driving unit and the suction member, wherein the driving unit includes a rotor having a slot to allow the movable member in the upward and downward direction with respect to the rotor.

The bracket may include an elevation guide face inclined with respect to the slot of the rotor to guide the movable member in the upward and downward directions when the movable member moves along the slot.

The bracket may further include a rotation guide face extended from the elevation guide face to guide the suction member between the folding direction and the unfolding direction when the suction member has been moved to the downward direction along the elevation guide face.

The bracket may further include a rotation guide face to maintain a downward position while moving between the folding direction and the unfolding direction.

The bracket may further include a rotation guide face to guide the suction member to move between the folding direction and the unfolding direction when the driving unit does not control the suction member.

The bracket may include a rotation guide face to maintain the suction member in an unfolding state after the suction member moves to the unfolding direction.

The cleaning robot may further include an elastic unit coupled between the suction member and the driving unit to control the suction member and the driving unit to control the suction member to move along the rotation guide face in the unfolded state.

The cleaning robot may further include an elastic member coupled between the suction member and the driving unit to control the suction member to move with respect to the rotation guide face in the unfolded state.

The corner cleaning unit may control the suction member to maintain an unfolded state after moving to the unfolding direction and the downward direction.

The corner cleaning unit may control the suction member to move in a first direction and a second direction in the unfolded state according to a height of a first reference and a distance of a second reference with respect to the main body.

The foregoing and/or other aspects and utilities of the present general inventive concept may also be achieved by providing a method of cleaning a surface using a cleaning robot with a main body and a suction member, the method including moving the suction member in a folding direction and an unfolding direction with respect to the main body, and moving the suction member in an upward direction and a downward direction with respect to the main body, when the suction member moves to the folding direction and the unfolding direction.

The method may further include controlling the suction member to simultaneously move in the unfolding direction and the downward direction, and to simultaneously move in the folding direction and the upward direction.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
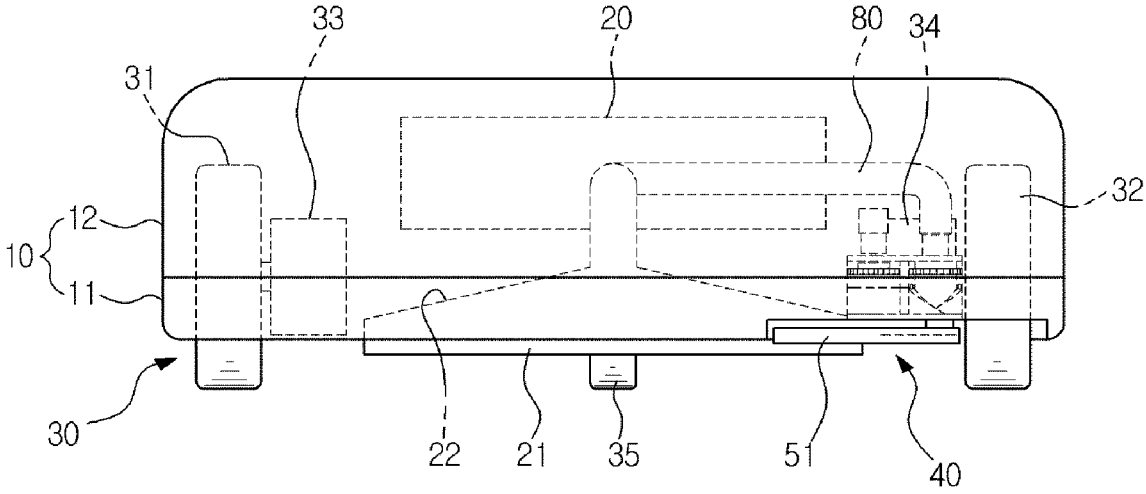
FIG. 1 is a front view illustrating a construction of a cleaning robot according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
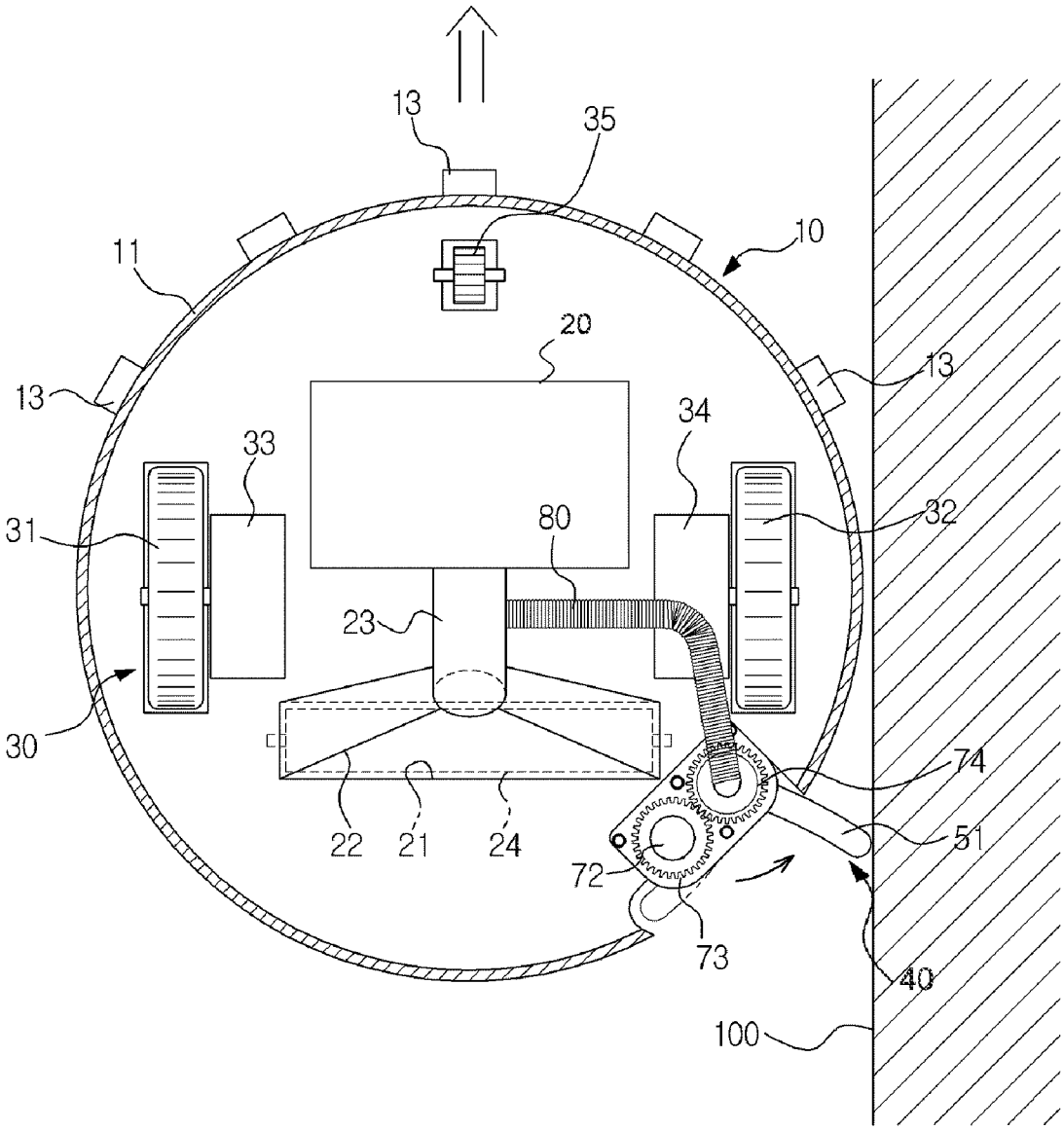
FIG. 2 is a top plan view illustrating main parts of a cleaning robot according to an embodiment of the present general inventive concept.

As illustrated in FIGS. 1 and 2, a cleaning robot according to an embodiment of the present general inventive concept includes a dust collecting unit 20 installed in a main body 10, a traveling unit 30 to move the main body 10, and a corner cleaning unit 40 to clean a corner adjacent to a wall.

The main body 10 has a roughly circular shape to facilitate easy turning. The main body 10 includes a lower case 11, and an upper case 12 disposed above the lower case 11 to cover the lower case 11 and components installed therein. As illustrated in FIG. 2, the main body 10 is provided with a plurality of obstacle sensors 13 at predetermined intervals at an outer circumferential portion of the main body 10 thereof. The obstacle sensors 13 can measure a distance between the main body 10 and an obstacle or between the main body 10 and a wall by sending out a signal such as an ultrasonic wave, and receiving a reflected signal.

The traveling unit 30 includes two traveling wheels 31 and 32 that are diagonally installed to a lower central portion of the main body 10, two traveling motors 33 and 34 to independently drive the traveling wheels 31 and 32, respectively, and a turn wheel 35 installed at a lower front portion of the main body 10. The traveling unit 30 causes the traveling motors 33 and 34 to rotate the traveling wheels 31 and 32, respectively, in a forward or backward direction according to a control signal of a controller (not illustrated), thereby allowing the main body 10 to travel. The traveling direction of the main body 10 is determined by differentially controlling rotating directions and speeds of the traveling motors 33 and 34. The turn wheel 35 has the structure of a caster capable of freely pivoting in the traveling direction of the main body 10.

Although not illustrated in detail, the dust collecting unit 20 in the main body 10 may include a suction fan (not illustrated) to draw in foreign material such as dust and dirt together with air through a main suction port 21 formed on a lower surface of the main body 10, a suction motor which drives the suction fan, and a filtering unit which filters the foreign materials from the drawn-in air. The filtering unit can include a regular cyclone or dust bag.

A suction duct 22 and a suction guide pipe 23, all of which guide the suction of the foreign materials and air, are interposed between the dust collecting unit 20 and the main suction port 21. As illustrated in FIG. 2, the main suction port 21 can be rotatably provided with a brush 24. The brush 24 can include a turbine brush rotated by the force of wind or a power brush rotated by an electric motor.

Figure 3:
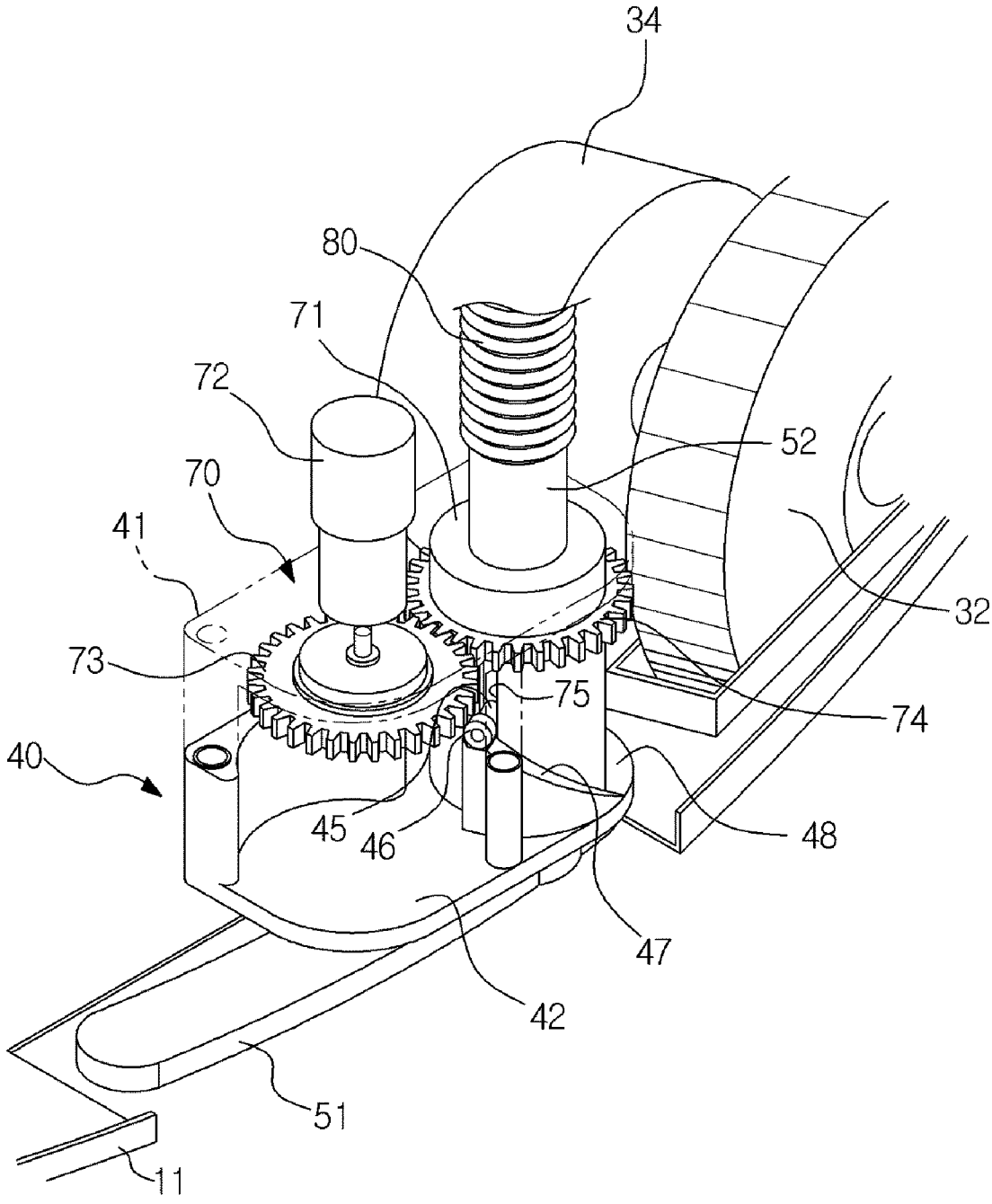
FIG. 3 is a perspective view illustrating a corner cleaning unit in a cleaning robot according to an embodiment of the present general inventive concept, wherein a suction member is in a folded state.
Figure 4:
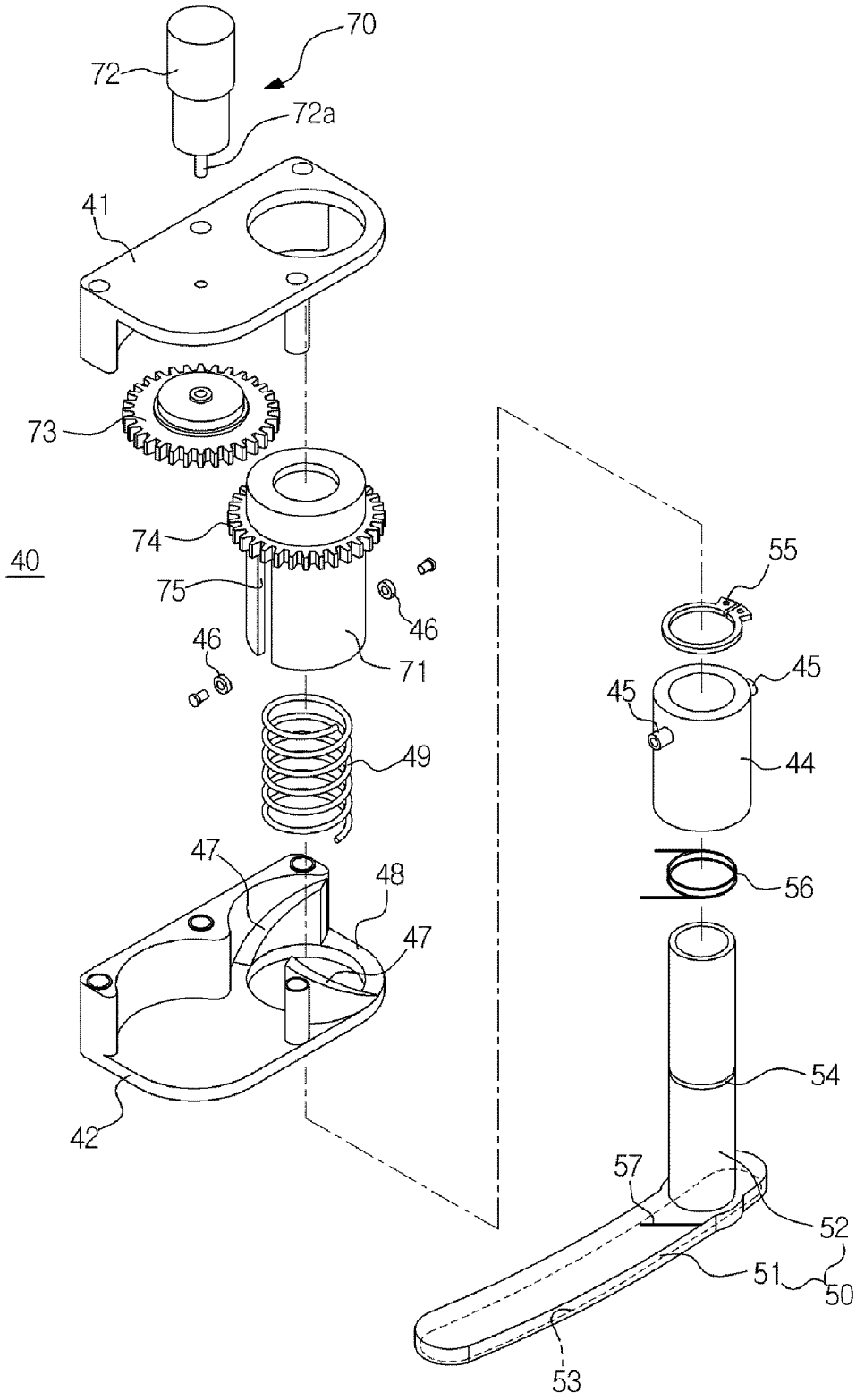
FIG. 4 is an exploded perspective view illustrating the corner cleaning unit of FIG. 3 in a cleaning robot according to an embodiment of the present general inventive concept.

As illustrated in FIGS. 2 and 3, the corner cleaning unit 40 is radially installed at a rear edge of the main body 10. As illustrated in FIG. 4, the corner cleaning unit 40 includes an upper supporting bracket 41 and a lower supporting bracket 42 coupled to the main body 10, a suction member 50 rotatably and elevatably coupled to both the upper supporting bracket 41 and the lower supporting bracket 42, and a driving unit 70 to move and/or rotate the suction member 50.

Figure 5:
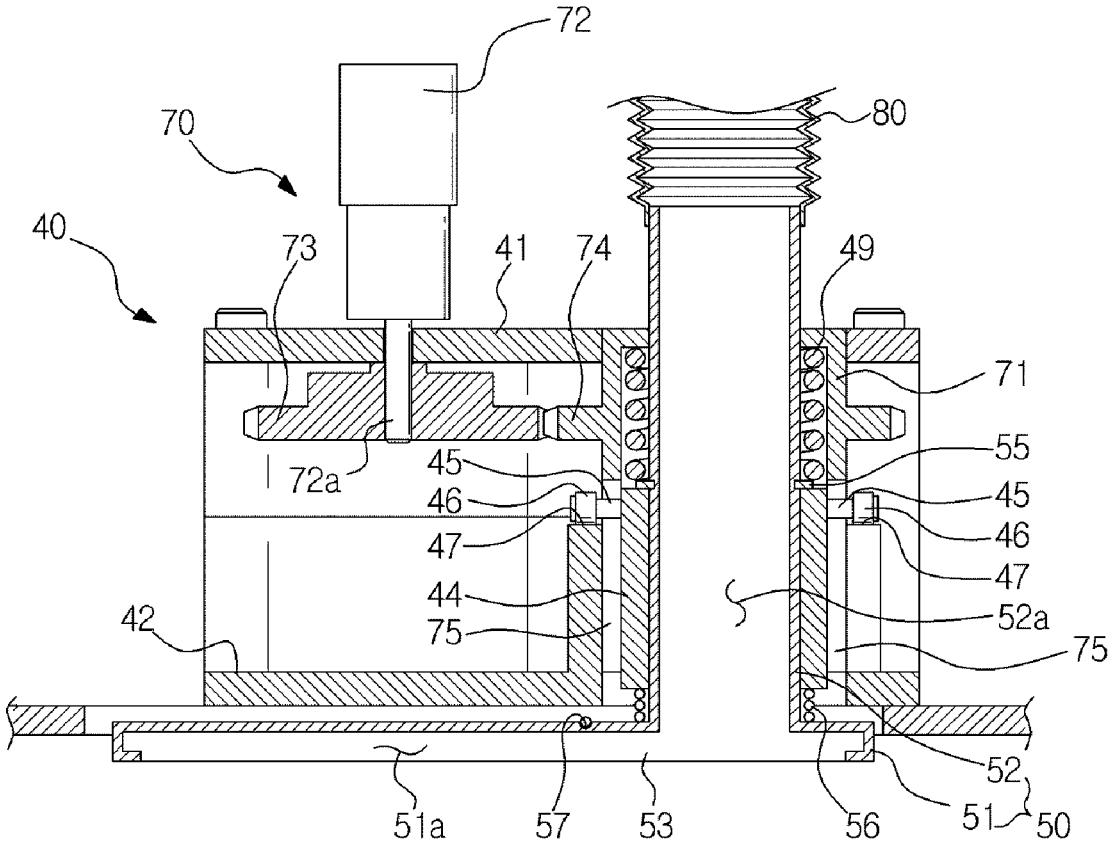
FIG. 5 is a sectional view illustrating the corner cleaning unit of FIG. 3 in a cleaning robot according to an embodiment of the present general inventive concept.

As illustrated in FIGS. 4 and 5, the suction member 50 includes a suction arm 51 that is formed long in a transverse direction and is provided therein with a horizontal suction channel 51*a*, and a rotatable cylinder 52 that extends upwards from one end of the suction arm 51 and is provided therein with a vertical suction channel 52*a* to communicate with the horizontal suction channel 51*a* of the suction arm 51 and the connecting pipe 80 and the dust collecting unit 20. The suction arm 51 is provided with a suction port 53, which draws foreign materials together with air, at a lower surface thereof. As illustrated in FIGS. 2 and 3, the suction arm 51 rotates about the rotatable cylinder 52, so that the suction port 53 allows the suction arm 51 to be unfolded from or folded to the main body 10. That is, the suction arm 51 moves during a folded state and an unfolded state with respect to the main body 10.

As illustrated in FIGS. 4 and 5, the rotatable cylinder 52 of the suction member 50 has a cylindrical movable member 44 fitted therearound, which can move up and down together with the suction member 50 while simultaneously rotating relative to the rotatable cylinder 52. In order to install the movable member 44, the rotatable cylinder 52 is provided with a ring groove 54 on an outer surface thereof, and the ring groove 54 is fitted with a snap ring 55 to restrict the movable member 44 to the upward and the downward movement with respect to the rotatable cylinder 52. Specifically, the movable member 44 is first fitted around the rotatable cylinder 52, and then the snap ring 55 is fitted into the ring groove 54 of the rotatable cylinder 52 such that a top surface of the movable member 44 is caught.

A torsion spring 56 is installed between the suction arm 51 of the suction member 50 and the movable member 44. The torsion spring 56 is fitted around the rotatable cylinder 52. The torsion spring 56 can be fixed to the movable member 44 at one end thereof and can be fitted into a spring hook groove 57 on an upper surface of the suction arm 51 at the other end thereof. The torsion spring 56 may be first fitted around the rotatable cylinder 52 before the movable member 44 is mounted.

The torsion spring 56 acts as a connector between the movable member 44 and the suction member 50. Thereby, the suction member 50 is allowed to be rotated when the movable member 44 is rotated by the operation of a driving unit 70 that will be described below, and be relatively rotated within a range of elastic deformation when the suction arm 51 collides with an obstacle during cleaning. In other words, as illustrated in FIG. 2, when the suction arm 51 collides with an obstacle while the main body 10 is traveling with the suction arm 51 unfolded, the suction arm 51 can be folded toward the main body 10. After passing through the obstacle, the suction arm 51 is again unfolded by elasticity of the torsion spring 56.

The driving unit 70 includes a rotor 71 fitted on an outer surface of the movable member 44, a driving motor 72 fixed to the upper supporting bracket 41, a driving gear 73 coupled to a shaft 72*a* of the driving motor 72 to transmit a rotating force of the driving motor 72 to the rotor 71, and a driven gear 74 formed on an outer surface of the rotor 71 to be engaged with the driving gear 73.

The rotor 71 has a cylindrical shape to be able to move up and down the movable member 44 fitted therein, and is rotatably coupled to the upper supporting bracket 41 at an upper portion thereof such that the rotor itself can be restricted to upward and downward movement, and is also rotatably coupled to the lower supporting bracket 42 at a lower portion thereof. Further, the rotor 71 can be provided with long guide slots 75 in a vertical direction to be able to transmit the rotating force of the rotor 71 to the movable member 44 and to simultaneously move the movable member 44 upwards and downwards. The movable member 44 is provided with guide knobs 45 fitted into the guide slots 75 on the outer surface thereof, so that the cylindrical movable member 44 moves up and down with respect to the rotor 71.

The lower supporting bracket 42 is provided with spiral-shaped elevation guide faces 47 around the rotor 71 such that the movable member 44 can move upwards and downwards by the elevation guide faces 47 while the movable member 44 is rotated by the rotor 71. The elevation guide faces 47 support the guide knobs 45 that protrude outwards from the movable member 44 through the guide slots 75. Further, the guide knobs 45 are provided with rollers 46 to roll along the elevation guide faces 47, respectively. Thereby, when the rotor 71 is rotated by an operation of the driving motor 72, the suction arm 51 can be unfolded from the main body 10 while the suction member 50 is rotating together with the movable member 44. While the above operations are occurring, the guide knobs 45 can simultaneously move downwards along the elevation guide faces 47, thereby allowing the movable member 44 and the suction member 50 to move downwards.

Figure 8:
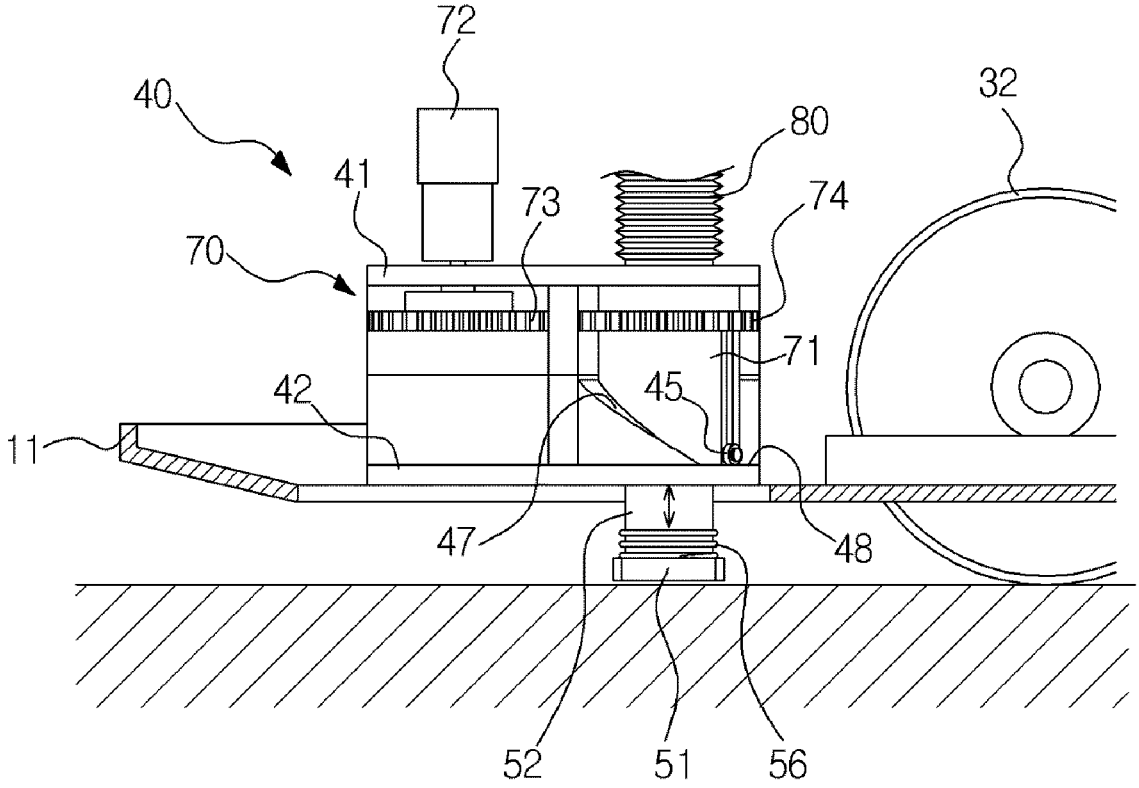
FIG. 8 is a side view illustrating the corner cleaning unit of FIG. 3 in a cleaning robot according to an embodiment of the present general inventive concept, wherein a suction member is in an unfolded state.

Further, the lower supporting bracket 42 is provided with a rotation guide face 48, which extends from a lower end of each elevation guide face 47 in a same direction (i.e., a horizontal direction) as the rotating direction of the suction member 50, such that the guide knobs 45 which move downwards along the elevation guide faces 47 can be rotated within a predetermined central angle with no change in height. Thus, as illustrated in FIG. 8, the suction member 50 can be unfolded while rotating in a counterclockwise direction without additional downward movement after moving downwards to approach a surface to be cleaned.

As illustrated in FIGS. 3 and 4, spaces extending upwards from the elevation guide faces 47 and the rotation guide faces 48 serve as open spaces to allow the guide knobs 45 to move upwards and downwards. The rotor 71 is provided therein with a coil spring 49 pressing the movable member 44 in a downward direction. This allows the suction member 50 to move upwards and downwards without rotation depending on a change of a height of the floor to be cleaned while the cleaning robot travels on an uneven floor, and thus to accommodate the height change of the uneven floor. Accordingly, the guide knobs 45 can move upwards along the guide slots 75 of the rotor 71 together with the movable member 44, thereby separating from the rotation guide face 48. Thus, when the cleaning robot travels on the uneven floor, which can include a carpet, etc., the lower surface of the suction arm 51 can be in close vicinity to the uneven floor, and simultaneously the suction arm 51 can be maintained in a completely unfolded state.

As illustrated in FIGS. 3 and 5, the rotatable cylinder 52 of the suction member 50 extends beyond the rotor 71. The rotatable cylinder 52 is connected, at the upper portion thereof, with the suction guide pipe 23 of the dust collecting unit 20 by means of a connecting pipe 80. Thus, when the dust collecting unit 20 is actuated, air and foreign materials can be drawn through the suction port 53 of the suction member 50.

An operation of the corner cleaning unit of the cleaning robot will be described below.

Figure 7:
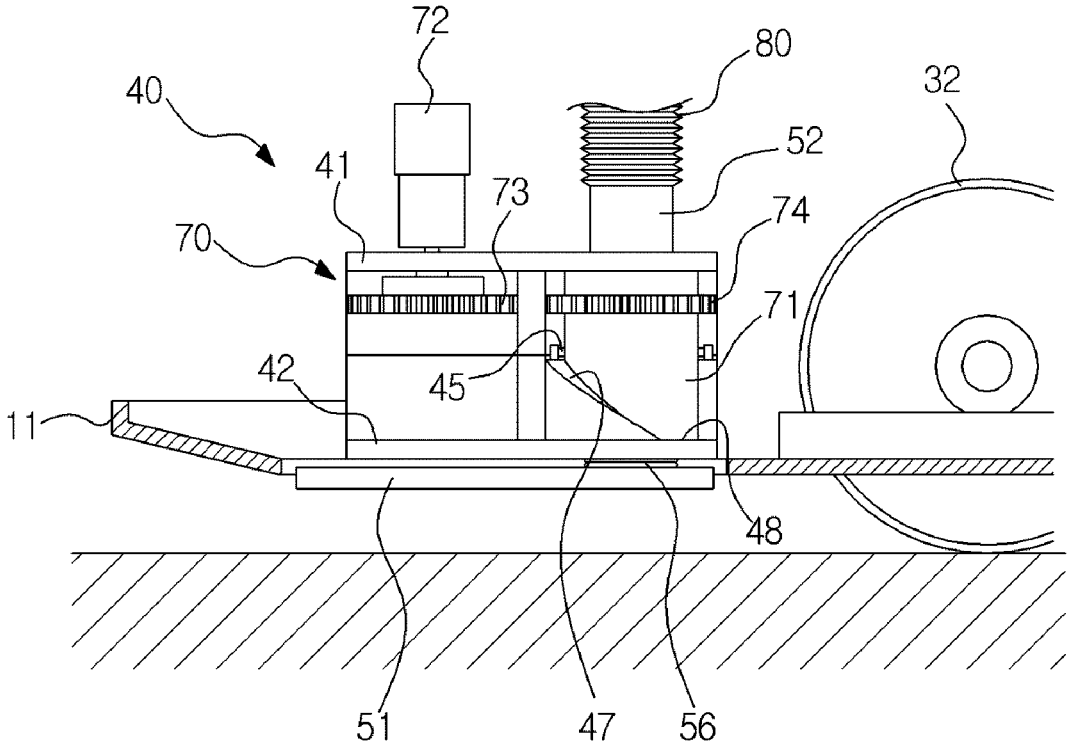
FIG. 7 is a side view illustrating the corner cleaning unit of FIG. 3 in a cleaning robot according to an embodiment of the present general inventive concept, wherein a suction member is in a folded state.

When the corner cleaning unit 40 is not used, the roller 46 of the guide knobs 45 are located on the elevation guide faces 47, as illustrated in FIGS. 3 and 7. Thus, the movable member 44 is in a raised state, and the suction member 50 is also in a raised state. The suction arm 51 is also folded toward the main body 10.

Figure 6:
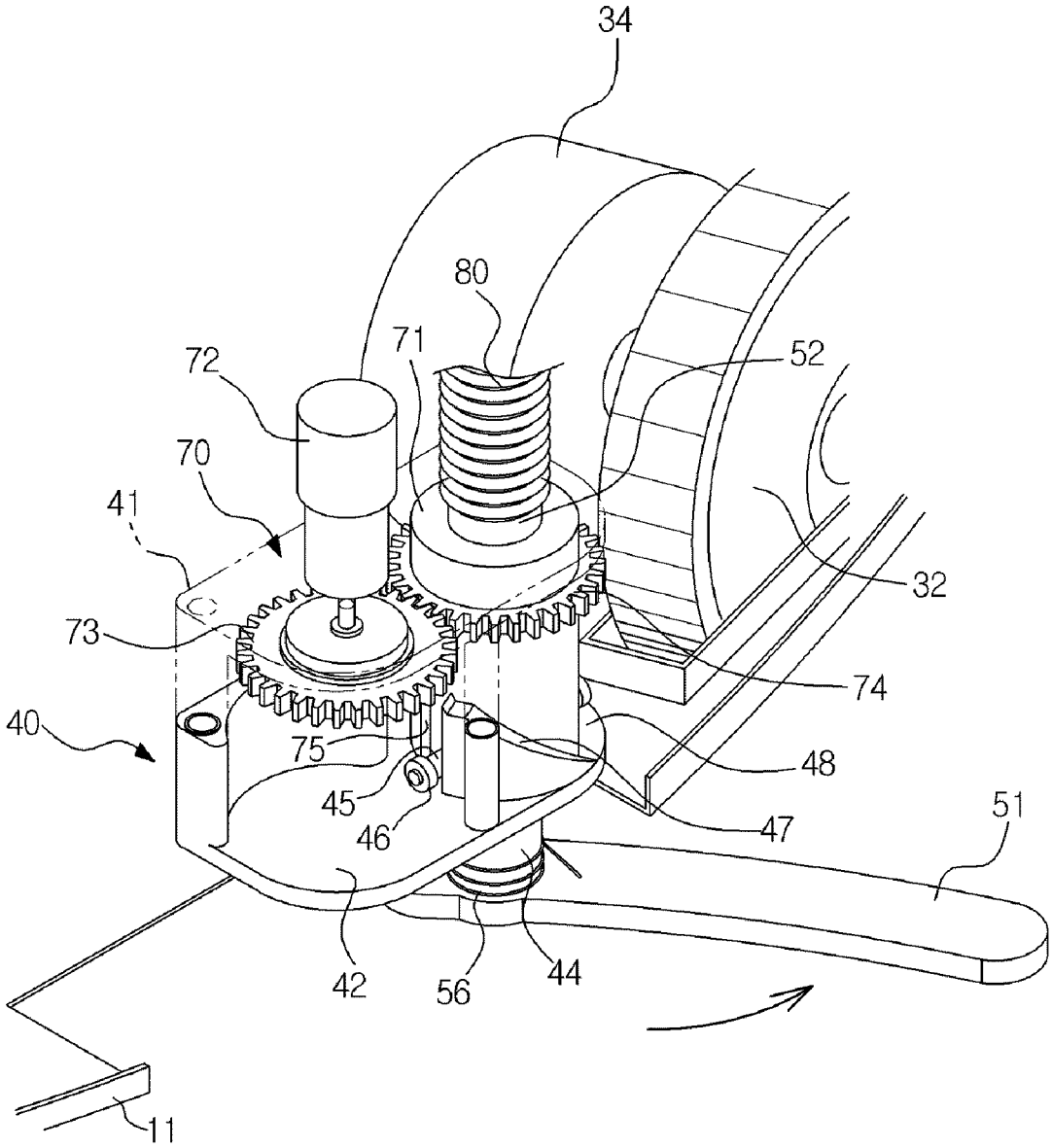
FIG. 6 is a perspective view illustrating the corner cleaning unit of FIG. 3 in a cleaning robot according to an embodiment of the present general inventive concept, wherein a suction member is in an unfolded state.

As illustrated in FIGS. 2 and 6, when the cleaning robot travels toward a wall 100 and cleans a corner adjacent to the wall 100, the suction arm 51 of the suction member 50 is unfolded from the main body 10 by an operation of the driving motor 72. Accordingly, the rotating force of the driving motor 72 is transmitted to the rotor 71 through the driving gear 73 and the driven gear 74. The rotating force of the rotor 71 is transmitted to the movable member 44 through the guide knobs 45, and the rotating force of the movable member 44 is transmitted to the suction member 50 through the torsion spring 56. As illustrated in FIGS. 6 and 8, when the driving motor 72 is driven, the suction arm 51 of the suction member 50 is unfolded from the main body 10 while rotating in a counterclockwise direction, the guide knobs 45 of the movable member 44 move downwards along the elevation guide faces 47, and the suction port 53 of the suction member 50 is lowered to be adjacent to the floor to be cleaned.

Further, after the suction member 50 is lowered to be adjacent to the floor to be cleaned and when the driving motor 72 is additionally driven, the guide knobs 45 are guided along the rotation guide face 48. At this time, the suction member 50 is no longer rotated, and the suction arm 51 is unfolded while rotating at a predetermined central angle. After the suction member 50 is completely unfolded, the driving motor 72 is stopped. In this state, the cleaning robot can travel along the wall 100 and clean the corner, as illustrated in FIG. 2. Since the space above the rotation guide face 48 is an open space in which the guide knob 45 is freely movable upward, it is possible that suction member 50 moves up according to a height of the uneven floor surface.

When the suction arm 51 of the suction member 50 collides with an obstacle while the cleaning robot is traveling, the suction arm 51 is pushed backwards from the obstacle, and is rotated toward the main body 10, so that it can pass by the obstacle. At this time, the movable member 44 is not rotated, but only the suction member 50 is rotated according to the rotation guide face 48 and the torsion spring 56. After passing by the obstacle, the suction member 50 is restored to an original position by means of the elasticity of the torsion spring 56. Further, because the suction member 50 is rotated without upward and downward movement by means of the collision with the obstacle, the suction member 50 maintains a fixed interval with respect to the floor to be cleaned. As a result, a cleaning effect can be increased.

When the cleaning robot travels on the uneven floor, the lower surface of the suction member 50 can be pushed upwards in close vicinity to the floor to be cleaned. In this case, because the guide knobs 45 can move upwards and downwards in the open space above the elevation guide faces 47 and the rotation guide faces 48, the suction member 50 can move upwards and downwards in response to the height change of the uneven floor. In other words, because the movable member 44 can move upwards and downwards without rotation of the suction member 50, the cleaning can be carried out with the suction member 50 unfolded completely.

When the cleaning of the corner is completed, the driving motor 72 is reversely driven, and thereby the suction arm 51 of the suction member 50 can be folded toward the main body 10. At this time, because the guide knobs 45 moves upwards along the elevation guide faces 47, the suction member 50 can move upwards.

As described above, according to a cleaning robot of the present general inventive concept, because a suction member of a corner cleaning unit is rotatably coupled to a movable member through the torsion spring, the suction member can be prevented from moving upwards although the suction arm of the suction member is rotated by a collision with an obstacle. Therefore, a cleaning effect can be increased.

Further, the suction member and the movable member can move upwards without rotation. As such, although a lower surface of the suction member may be pushed upwards in close vicinity to an uneven floor to be cleaned while the cleaning robot is traveling on the uneven floor like a carpet, this change in height can be accommodated, and the cleaning can be carried out while the suction member is unfolded completely in close vicinity to the uneven floor.

Further, because the suction member is rotated during operation of the driving motor, the suction member can be automatically folded and unfolded.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A cleaning robot, comprising:

a main body to travel on a floor to be cleaned;

a dust collecting unit installed in the main body; and a corner cleaning unit installed in the main body, and comprising a suction member having a suction arm unfolded from the main body by means of rotation, and a rotatable cylinder connected to the suction arm;

a movable member rotatably coupled around the rotatable cylinder of the suction member by a torsion spring such that the movable member moves upwards and downwards together with the suction member;

a driving unit to rotate the movable member;

supporting brackets provided in the main body to support the driving unit;

at least one elevation guide face formed at one of the supporting brackets to allow the movable member to move upwards and downwards along the elevation guide face as the movable member rotates; and at least one guide knob provided to the movable member in such a manner that the guide knob moves upwards and downwards along the elevation guide face, wherein the guide knobs are provided with rollers, respectively, in such a manner that the rollers to roll along the elevation guide faces and the rotation guide faces.

2. The cleaning robot as claimed in claim 1, wherein the supporting brackets are formed with rotation guide faces which extend from a lower end of each elevation guide face in the same direction as a rotating direction of the suction member to guide a rotational movement of the guide knob that has moved downwards along the elevation guide face.

3. The cleaning robot as claimed in claim 2, wherein:

a space is formed above the elevation guide face, and the rotation guide face allows the guide knob to move upwards in the space.

4. The cleaning robot as claimed in claim 3, wherein the driving unit comprises:

a cylindrical rotor installed on an outer surface of the movable member to rotate the movable member and is formed with long guide slots aligned in a longitudinal direction to guide an upward movement and a downward movement of the guide knob; and a driving motor coupled with the support bracket to rotate the cylindrical rotor in a forward direction or a reverse direction.

5. The cleaning robot as claimed in claim 4, wherein the driving unit further comprises:

a driving gear coupled to a shaft of the driving motor to transmit a rotational force of the driving motor to the cylindrical rotor; and a driven gear provided at an outer surface of the cylindrical rotor to be engaged with the driving gear.

6. The cleaning robot as claimed in claim 4, wherein the cylindrical rotor is rotatably supported on the support bracket in a state in which the upward and downward movements of the cylindrical rotor are restricted.

7. The cleaning robot as claimed in claim 4, wherein the cylindrical rotor is provided therein with a coil spring to bias the movable member in a downward direction.

8. The cleaning robot as claimed in claim 1, wherein:

the rotatable cylinder is provided therein with a suction channel; and the suction channel is connected to the dust collecting unit through a connecting pipe.

9. A cleaning robot, comprising:

a main body to travel on a floor to be cleaned;

a dust collecting unit installed in the main body;

a corner cleaning unit installed in the main body, comprising a suction member having a suction arm unfolded from the main body by means of rotation, and a rotatable cylinder connected to the suction arm a bracket mounted to the main body to guide the suction member to move in one of a downward direction and an upward direction, and a rotation guide face to guide the suction member between a folding direction and an unfolding direction when the suction member has been moved to the downward direction; and a driving motor to rotate the rotatable cylinder in a forward or reverse direction to automatically fold or unfold the suction arm.

10. A cleaning robot, comprising:

a main body; and a corner cleaning unit having a suction member, and to move the suction member in a folding direction and an unfolding direction with respect to the main body, and to move the suction member in an upward direction and a downward direction with respect to the main body, when the suction member moves to the folding direction and the unfolding direction; and wherein the corner cleaning unit comprises:

a driving unit mounted to the main body to control the suction member to move in one of the folding direction and the unfolding direction; and a bracket mounted to the main body to guide the suction member to move in one of the downward direction and the upward direction, the bracket having:

an elevation guide face inclined with to the slot of the rotor to guide the movable member in the upward and downward directions when the movable member moves a long the slot; and a rotation guide face extended from the elevation guide face to guide the suction member between the folding direction and the unfolding direction when the suction member has been moved to the downward direction along the elevation guide face.

11. The cleaning robot of claim 10, further comprising:

a movable member disposed between the driving unit and the suction member, wherein the driving unit comprises a rotor having a slot to allow the movable member in the upward and downward direction with respect to the rotor.

12. The cleaning robot of claim 10, wherein the bracket further comprises:

a rotation guide face to guide the suction member to move between the folding direction and the unfolding direction when the driving unit does not control the suction member.

13. The cleaning robot of claim 10, further comprising:

an elastic member coupled between the suction member and the driving unit to control the suction member to move with respect to the rotation guide face in the unfolded state.

* * * * *